United States Patent [19]

Matsushita et al.

[11] 4,356,076

[45] Oct. 26, 1982

[54] APPARATUS FOR THE ANODIC OXIDATION OF ALUMINUM

[75] Inventors: Shizuo Matsushita; Yasuhito Togawa, both of Tokyo, Japan

[73] Assignee: Director-General of Agency of Industrial Science and Technology, Tokyo, Japan

[21] Appl. No.: 180,455

[22] Filed: Aug. 22, 1980

[30] Foreign Application Priority Data

Aug. 22, 1979 [JP] Japan ..... 54-106969

[51] Int. Cl.[3] ..... C25D 17/00; C25D 21/10; C25B 1/10; C25B 9/00

[52] U.S. Cl. ..... 204/261; 204/265; 204/266; 204/129; 204/38 A; 204/277; 204/278; 204/282

[58] Field of Search ..... 204/38 A, 129, 58, 265–266, 204/277–278, 282, 261

[56] References Cited

U.S. PATENT DOCUMENTS

| | | | |
|---|---|---|---|
| 826,301 | 7/1906 | Wood | 204/277 X |
| 1,354,498 | 10/1920 | Luib et al. | 204/266 X |
| 1,535,378 | 4/1925 | Richter et al. | 204/266 X |
| 3,082,160 | 3/1963 | Sabins | 204/129 X |
| 3,736,322 | 5/1973 | Helber et al. | 204/266 |
| 4,075,069 | 2/1978 | Shinohara et al. | 204/278 X |

*Primary Examiner*—Donald R. Valentine
*Attorney, Agent, or Firm*—Stephen F. K. Yee

[57] ABSTRACT

An apparatus for the anodic oxidation of aluminum permits the recovery of hydrogen generated from the cathode. The cathode is positioned within a tubular member provided with a multiplicity of small openings each having a size sufficient to allow passage of an electrolytic solution therethrough but to prevent passage of hydrogen bubbles therethrough. Thereby, the hydrogen is collected in the upper space above the surface of the electrolytic solution in the tubular member and is discharged therefrom through a conduit opening thereinto.

2 Claims, 3 Drawing Figures

APPARATUS FOR THE ANODIC OXIDATION OF ALUMINUM

BACKGROUND OF THE INVENTION

This invention relates generally to an apparatus for the anodic oxidation of aluminum and, more particularly, to such an apparatus adapted for recovering hydrogen generated at the cathode during anodic oxidation.

Treatment of aluminum by anodic oxidation is now adopted in a wide variety of fields. During anodic oxidation, a hydrogen gas is formed at the cathode. For example, about 0.2 Kg per hour of hydrogen is produced upon oxidation using 5000 A/hour of an electric current. Hitherto, such a hydrogen gas has been allowed to be discharged into the air without being utilized. In view of energy saving and effective utilization of resources, it is highly desired to collect the hydrogen for use, for instance, as a fuel.

SUMMARY OF THE INVENTION

The present invention provides an improved apparatus for the anodic oxidation of an aluminum piece, which includes a cell for containing an electrolytic solution, an anode member of the aluminum piece adapted to be electrically connected to a positive pole of a direct-current source and immersed in the electrolytic solution, and a cathode member adapted to be electrically connected to a negative pole of the direct-current source and immersed in the electrolytic solution so that the aluminum piece may be oxidized with the simultaneous formation of hydrogen at the cathode member when the aluminum piece and the cathode member are immersed in the electrolytic solution and a voltage from the direct-current source is impressed therebetween. The improvement involves: a tubular partition member defining a closed cathode chamber therein; a cathode member positioned within the cathode chamber; a plurality of openings provided at a lower portion of the partition member to permit entry of an electrolytic solution in the cathode chamber; a closed upper space defined above the surface of the electrolytic solution in the cathode chamber when the partition member is immersed in the electrolytic solution; each of the openings having a peripheral length of preferably 80 to 1200$\mu$ so that the hydrogen gas formed at the cathode member is prevented from escaping therethrough out of the cathode chamber, but is allowed to be collected within the upper space; and a conduit means opening into the upper space for discharging the hydrogen gas collected therewithin for the recovery thereof.

It is, accordingly, an object of the present invention to provide an apparatus for the anodic oxidation of aluminum, which permits recovery of hydrogen generated at the cathode.

BRIEF DESCRIPTION OF THE DRAWINGS

Other objects, features and advantages of the present invention will become apparent from the detailed description of the preferred embodiments of the invention which follows, when considered in light of the accompanying drawings, in which.

DESCRIPTION OF THE PREFERRED EMBODIMENTS

Figure 1:
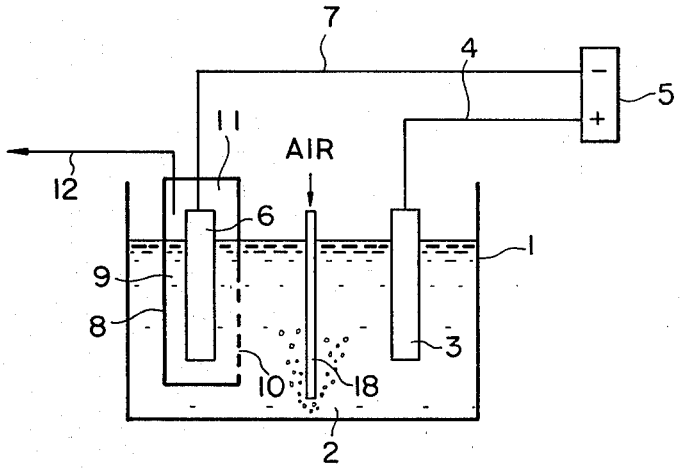
FIG. 1 is an elevational view diagrammatically showing an apparatus for the anodic oxidation of aluminum according to the present invention.

Referring first to FIG. 1, the reference numeral 1 denotes an electrolytic cell in which an electrolytic solution 2 is contained. Immersed in the electrolytic solution 2 is an aluminum piece 3 to be treated. The aluminum piece 3 is electrically connected by means of a lead wire 4 to a positive pole of a direct-current source 5 and serves as an anode. A cathode member 6 formed of, for example, aluminum or graphite, is immersed in the electrolytic solution 2 at a position spaced apart from the aluminum piece 3. The cathode member 6 is connected to a negative pole of the direct-current source 5 by means of a lead wire 7.

As a result of this construction, when a power switch (not shown) is ON to couple both the aluminum piece 3 and the cathode member 6 with the direct-current source, a voltage is impressed therebetween whereby the aluminum piece 3 may be oxidized with the simultaneous formation of a hydrogen gas at the cathode member 6. The reference numeral 18 denotes a means for stirring the electrolytic solution.

The cathode member 6 is surrounded by a tubular partition member 8 which defines a closed cathode chamber 9 therein. The partition member 8 has a plurality of small openings 10 provided at its lower portion which can face the aluminum piece 3. Each of the openings has a size sufficient to allow the electrolytic solution to enter into the cathode chamber 9 therethrough when the partition member 8 is immersed in the electrolytic solution 2, whereby an upper space 11 is defined above the surface of the solution 2 within the partition member 8. Further, the size of each opening 10 is such that the hydrogen gas formed at the cathode member 6 is prevented from passing therethrough out of the cathode chamber 9 but is collected in the upper space 11. Preferably, the size of each of the openings 10 is between 80 and 1200$\mu$ in terms of peripheral (or circumferential) length, more preferably between 200 and 800$\mu$.

A discharge conduit 12 opens into the upper space 11 so that the hydrogen gas within the upper space 11 may be withdrawn therethrough and recovered in a suitable tank (not shown). The discharge of the hydrogen gas from the upper space 11 can be effected by means of a pump or by maintaining the recovery tank under slightly reduced pressures.

The openings 10 can be formed by a multiplicity of small perforations directly formed at suitable portions of the partition member 8. Alternatively, the openings 10 may be formed by using a net member having a mesh size (Tyler) of 400 to 60 mesh, preferably 300 to 150 mesh.

Figure 2:
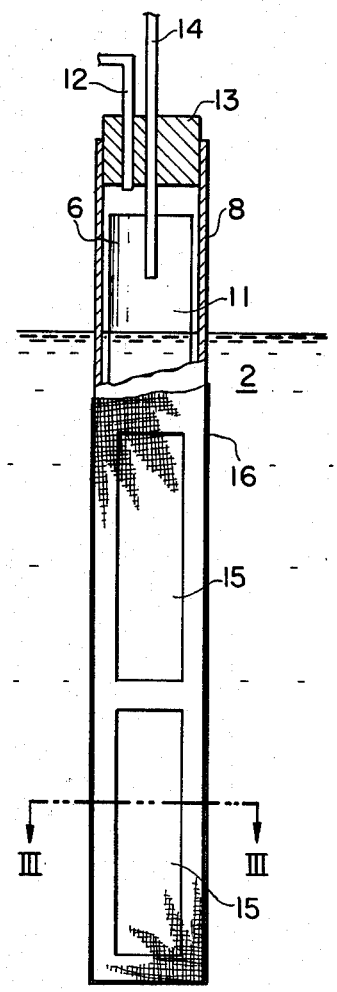
FIG. 2 is an enlarged elevational view, partially in cross-section, showing the cathode chamber of this invention.
Figure 3:
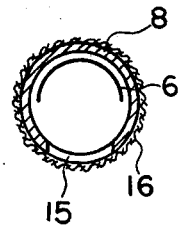
FIG. 3 is a cross-section taken on line III—III' of FIG. 2.

FIGS. 2 and 3 depict one of the embodiments of the partition member 8. The partition member 8 in this embodiment is a plastic pipe whose top open end is provided with a rubber cork 13 for sealing, through which a terminal member 14 extends into inside of the partition member 8. The cathode member 6 of a semicylindrical form is connected to and supported by the terminal 14. The hydrogen gas-discharge conduit means 12 also extends through the rubber cork 13 into the pipe 8. The pipe (or partition member) 8 has one or more large openings 15 (in this illustrated case two). A net member 16 formed of a polymer material having resistance to acids, such as polyamides, polyesters and the like, surrounds the pipe 8 to cover the openings 15. As a result of this construction, the hydrogen gas formed at the cathode member 6 is prevented from passing through the openings covered with the net member 16, but is allowed to be collected in the upper space 11 above the liquid surface within the pipe 8. The hydrogen gas in the space 11 is then discharged through the conduit 12 for recovery.

To improve the efficiency of anodic oxidation, the electrolytic solution is generally stirred. The stirrer 18 shown in FIG. 1 blows an air stream into the solution 2. Since air bubbles thus formed have sufficiently larger sizes than those of the openings 10 (or mesh size of the net member 16), the air cannot enter into the inside of the partition member 8, whereby the oxygen content in the recovered hydrogen gas product is very small. Further, since the electrolytic solution can freely pass through the openings 10, the provision of the partition member does not cause undesirable increase in electrolytic voltage.

The following example will further illustrate the present invention.

EXAMPLE

An aluminum plate (size: 100×150 mm) whose one side surface was covered with a resinous coating was subjected to anodic oxidation using the cathode member as shown in FIG. 2. 2.5 liters of an electrolytic solution containing 150 g/l of sulfuric acid was contained in the cell. An aluminum plate having a total surface area of 0.75 $dm^2$ was used as a cathode member 6, and was placed in a vinyl chloride pipe 8 having an inside diameter of 40 mm and a length of 350 mm. Openings 15 of the pipe 8 having a total area of about 150 $cm^2$ were covered with a Nylon net 16 having a mesh size, in terms of peripheral length, of 896, 376 or 232$\mu$. Anodic oxidation was continued, with or without stirring the electrolytic solution by means of air bubbles, until a total of one liter of a gas was discharged from a discharge conduit 12. The recovery rate of hydrogen was calculated according to the following equation:

$$\text{Recovery rate (\%)} = \frac{B}{A} \times (1 - w) \times 100$$

wherein "A" stands for the actual amount of electricity required to obtain one liter of the gas, "B" stands for the theoretical electricity required to obtain one liter of hydrogen (i. e. 8620 coulomb); and "w" for the content of water in the gas recovered.

The results were as summarized in the table below.

| Size of Nylon net ($\mu$) | Without stirring | | With stirring | |
|---|---|---|---|---|
| | Electricity (coulomb) | Recovery rate (%) | Electricity (coulomb) | Recovery rate (%) |
| 896 | 8780 | 95.1 | 9180 | 91.0 |
| 376 | 8390 | 99.6 | 8770 | 95.2 |
| 232 | 8340 | 100.2 | 8380 | 99.7 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

We claim:

1. In an apparatus for the anodic oxidation of an aluminum piece, including a cell for containing an electrolytic solution, an anode member of the aluminum piece adapted to be electrically connected to the positive pole of a direct-current source and immersed in the electrolytic solution, and a cathode member adapted to be electrically connected to the negative pole of the direct-current source and immersed in the electrolytic solution so that the aluminum piece may be oxidized with the simultaneous formation of hydrogen gas at the cathode member when the aluminum piece and the cathode member are immersed in the electrolytic solution and a voltage is impressed therebetween, the improvement comprising:

an impervious tubular partition member surrounding and spaced from said cathode member to define a cathode chamber, said partition having an aperture at a lower portion;

a net member covering said aperture to provide a plurality of openings, each of said openings being of a size to permit entry of the electrolytic solution into said cathode chamber and to prevent escape from said cathode chamber of the hydrogen gas formed at the cathode member, each of said openings having a peripheral length in the range of 80$\mu$ to 1200$\mu$;

means closing the upper end of said partition member to form an enclosed space above the surface of the electrolytic solution in said cathode chamber with the partition member immersed in the electrolytic solution, said hydrogen gas being collected within the enclosed space;

conduit means opening into said enclosed space for removing and recovering the hydrogen gas collected therewithin; and means for introducing an air stream into the electrolytic solution to agitate the solution.

2. An apparatus as claimed in claim 1, wherein said net member has a mesh size of between 60 and 400 mesh.

* * * * *